US009096343B2

(12) United States Patent
Jolley

(10) Patent No.: US 9,096,343 B2
(45) Date of Patent: Aug. 4, 2015

(54) DISPLAY READY CONTAINER

(71) Applicant: Innovative Packaging Designs L.P., Montgomeryville, PA (US)

(72) Inventor: Carl Jeffrey Jolley, Plymouth Meeting, PA (US)

(73) Assignee: Innovative Packaging Designs L.P., Montgomeryville, PA (US)

( * ) Notice: Subject to any disclaimer, the term of this patent is extended or adjusted under 35 U.S.C. 154(b) by 36 days.

(21) Appl. No.: 13/829,574

(22) Filed: Mar. 14, 2013

(65) Prior Publication Data

US 2013/0256391 A1 Oct. 3, 2013

Related U.S. Application Data

(60) Provisional application No. 61/619,698, filed on Apr. 3, 2012.

(51) Int. Cl.

| | |
|---|---|
| ***B65D 5/36*** | (2006.01) |
| ***B65D 5/32*** | (2006.01) |
| ***B65D 5/54*** | (2006.01) |
| *B65D 5/02* | (2006.01) |
| *B65D 5/68* | (2006.01) |
| *B65D 5/16* | (2006.01) |

(52) U.S. Cl.

CPC *B65D 5/36* (2013.01); *B65D 5/328* (2013.01); *B65D 5/5445* (2013.01); *B65D 5/0281* (2013.01); *B65D 5/16* (2013.01); *B65D 5/68* (2013.01)

(58) Field of Classification Search

CPC ..... B65D 5/68; B65D 5/0281; B65D 5/16
USPC ..... 229/211, 125.29, 235, 225, 210, 229/125.16; 206/155
See application file for complete search history.

(56) References Cited

U.S. PATENT DOCUMENTS

| | | | | |
|---|---|---|---|---|
| 5,348,147 | A * | 9/1994 | Gottfreid | 206/215 |
| 5,505,368 | A | 4/1996 | Kanter et al. | |
| 6,325,282 | B1 | 12/2001 | Kanter et al. | |
| 7,484,654 | B2 | 2/2009 | Tibbles et al. | |
| 7,798,391 | B2 | 9/2010 | Tibbels et al. | |
| 8,740,053 | B2 * | 6/2014 | Snyder | 229/123.2 |

* cited by examiner

*Primary Examiner* — Christopher Demeree
(74) *Attorney, Agent, or Firm* — Fox Rothschild LLP

(57) ABSTRACT

A container knockdown assembly capable of opening into an erected container assembly. The knockdown includes an unopened outer sleeve having first and second outer side panels opposing and substantially parallel to one another when in the knockdown form, and an unopened inner sleeve having first and second inner side panels opposing and substantially parallel to one another when in the knockdown form. The inner sleeve is secured within the outer sleeve in a positional relationship of the assembled container. A cutout is formed in a section of one of the outer corners of the outer sleeve to expose at least a portion of a corner of the inner corner. A container formed from such a knockdown is also provided.

19 Claims, 12 Drawing Sheets

94
82
28
34
55
84
122
24
82a
88
36
58
14
10
8
62
46
50
92
78
8
12
22
32
78
128
30
98

16
18
22
26
26b
28
30
32
34
36
38
40
42
44
56
58
60
62
64
66
68
68a
70
72
72a
76
78
82
84
86
88
92
96
100

FIG.10
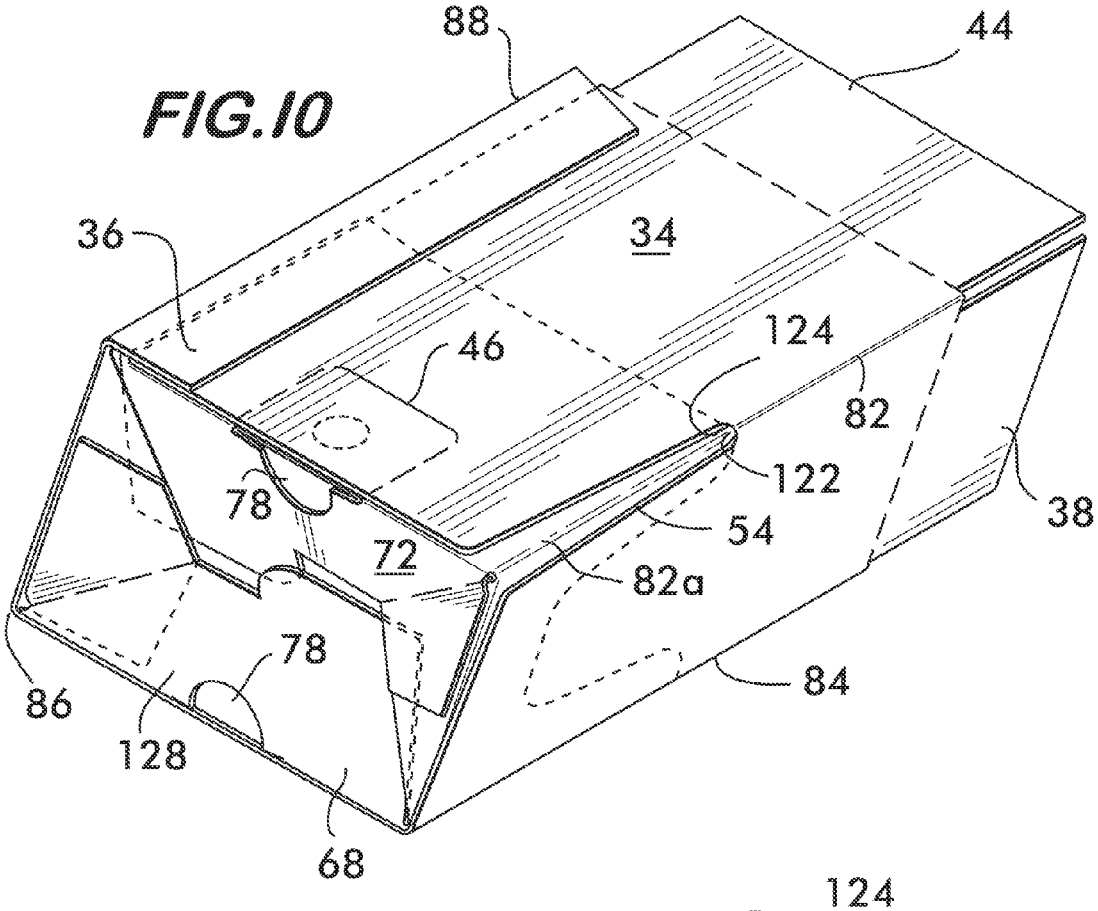
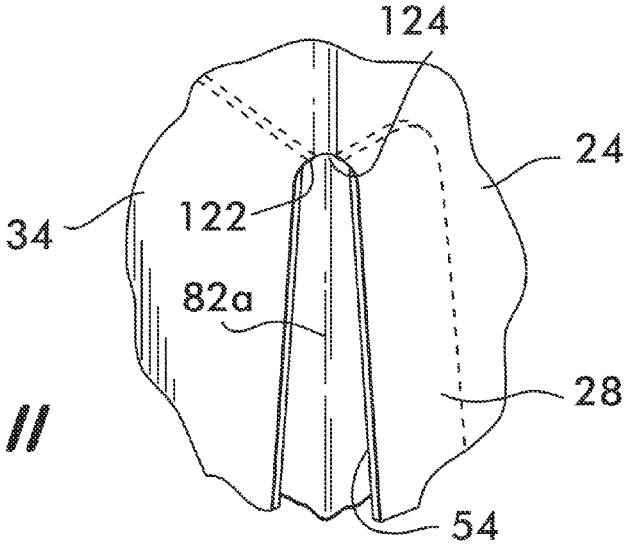
FIG.11

DISPLAY READY CONTAINER

CROSS-REFERENCE TO RELATED APPLICATION

This application claims the benefit of U.S. Provisional Application 61/619,698, filed Apr. 3, 2012, and which is hereby incorporated herein by reference.

BACKGROUND OF THE INVENTION

1. Field of the Invention

The present invention pertains to containers used for packaging, shipping, and displaying goods. More particularly, the invention relates to containers having a bottom container section for holding goods therein, and an upper cover section for covering the goods held within the bottom section.

2. Description of the Related Art

Display ready containers have become very popular, particularly in retail stores where goods for sale are displayed in the container in which they were shipped. A typical display ready container has separate top and bottom sections formed from separate blanks. The bottom section has side walls and flaps for forming the container bottom. The upper section has side walls and flaps for forming the container top. The upper section typically fits over the side walls of the bottom section to enclose the interior of the container and protect the goods inside, although other configurations are possible. The upper and bottom sections can then be secured together for shipping. Once the container is at the retailer, the upper section can be removed to display the goods within the bottom section.

Display ready containers are particularly useful as shipping-display containers. Used to package and ship goods for retail, the outside face of the bottom section can be printed and/or designed with promotional information suitable for display on the retail floor. The retailer, after removing the upper section of the container, places the bottom container section containing the goods on the retail floor.

A previous disadvantage of such two piece containers was the number of steps necessary to assemble the container. This disadvantage was overcome with the development of display ready containers that allow for the automation of the set up, packaging and sealing of such containers. One such display ready container is disclosed in U.S. Pat. No. 5,505,368 which is hereby incorporated herein by reference. This patent provides a container assembly having an unopened outer sleeve (that forms the outer cover section when erected), and an unopened inner sleeve (that forms the inner container section when erected) positioned inside the outer sleeve. The inner and outer sleeves, in a flat unopened form also known as a knockdown, are adhered together relative to one another in the positional relationship of the final erected container assembly which allows the top forming flaps of the container assembly to be closed. This allows the container to be assembled and filled with goods with the outer cover section (upper section) already secured to the bottom container section. Once the container is filled with the goods, the top forming flaps attached to the outer cover section are folded over and sealed shut to enclose the container for shipment, thereby eliminating the step of placing the outer cover section over the bottom section, and thereby improving the automation of the packaging process. The retailer then separates the two container sections by breaking the adhesive joints between the two container sections, discarding the upper cover section, and using the bottom container section to hold and display goods on the retail floor.

A major advantage of display ready containers of the type described in U.S. Pat. No. 5,505,368 is the ability to automate much of the manufacture, assembly, and filling of the container with goods, thereby minimizing costs. In particular, automation of the manufacturing process has allowed major improvements in minimizing costs and manufacturing time. Previously, older machinery required the lower/inner section of a knockdown to be formed separately, folded from a blank and glued. This lower/inner section was then combined with the blank of the upper/outer section which was glued to and folded around the lower section. Moreover, older machines require greater tolerances between the component sections of the container during manufacture. If the sections are slightly misaligned, the greater tolerances allow for completion of the container, but this also produces a higher percentage of containers that functioned improperly. This is particularly problematic with auto bottom containers where a slight misalignment of the two sections relative to one another may prevent the container from opening properly.

Modern machinery, on the other hand, can combine, glue and fold the upper and lower container sections from flat blanks in a single pass through the machinery to make a completed knockdown ready for use, thereby reducing the number of steps needed to make the completed knockdown form of the container. Modern machines can also assemble the various components more precisely, allowing the construction of containers with smaller tolerances, thereby minimizing the percentage of containers that will fail, e.g., not open properly. As modern machines run faster and faster using less steps and with smaller tolerances, however, there is less room for misalignments of the two sections relative to one another when the two sections are combined. It has been found that existing containers are not capable of obtaining the full benefits of the new machinery as the higher production speeds may cause problems, and the tighter tolerances are difficult to obtain with current container configurations.

Accordingly, one object of the present invention is to provide an improved display ready container that can be manufactured using high speed automated equipment. Another object is to provide an improved container made with smaller tolerances to minimize the percentage of non-functioning containers. Other advantages will be obvious or may be learned by practice of the invention.

SUMMARY OF THE INVENTION

The present invention provides a new knockdown assembly capable of opening into an erected container assembly. The knockdown includes an outer sleeve having first and second outer side panels opposing and substantially parallel to one another when in the knockdown form and which are attached to one another at two outer sleeve corners on opposite ends of the outer sleeve. The outer sleeve is capable of being opened to form four outer container side walls of the erected container assembly. The knockdown further includes an unopened inner sleeve having first and second inner side panels opposing and substantially parallel to one another when in the knockdown form and which are attached to one another at two inner sleeve corners on opposite ends of the inner sleeve. The inner sleeve is capable of being opened to form four inner container side walls of the erected container assembly. The inner sleeve is secured within the outer sleeve in an positional relationship of the erected container assembly, and one of the two inner corners align with and is adjacent to one of the two outer corners and the other of the two inner corners aligns with and is adjacent to an other of the outer two corners. A cutout is formed in a section of the one outer corner exposing at least a portion of the one inner corner.

A container assembly formed by such a knockdown is also provided, as well as other features as further described below.

BRIEF DESCRIPTION OF THE DRAWINGS

The foregoing summary, as well as the following detailed description, will be better understood when read in conjunction with the accompanying drawings. For the purpose of illustrating the invention, there are shown in the drawings preferred embodiments. It is understood, however, that this invention is not limited to these embodiments and are to be limited only by the appended claims.

FIG. 10 is a perspective view of the container assembly of FIG. 1 partially assembled from the knockdown form as shown in FIG. 7;

FIG. 11 is an enlarged view of the corner section of the container assembly of FIG. 1;

DETAILED DESCRIPTION

The invention disclosed herein provides a novel container assembly and a container knockdown assembly. Described below is an illustrative embodiment of the invention suited for containers used for shipping and displaying goods for retail. It is understood, however, that the present invention is not so limited and can be adapted to other containers.

Figure 1:
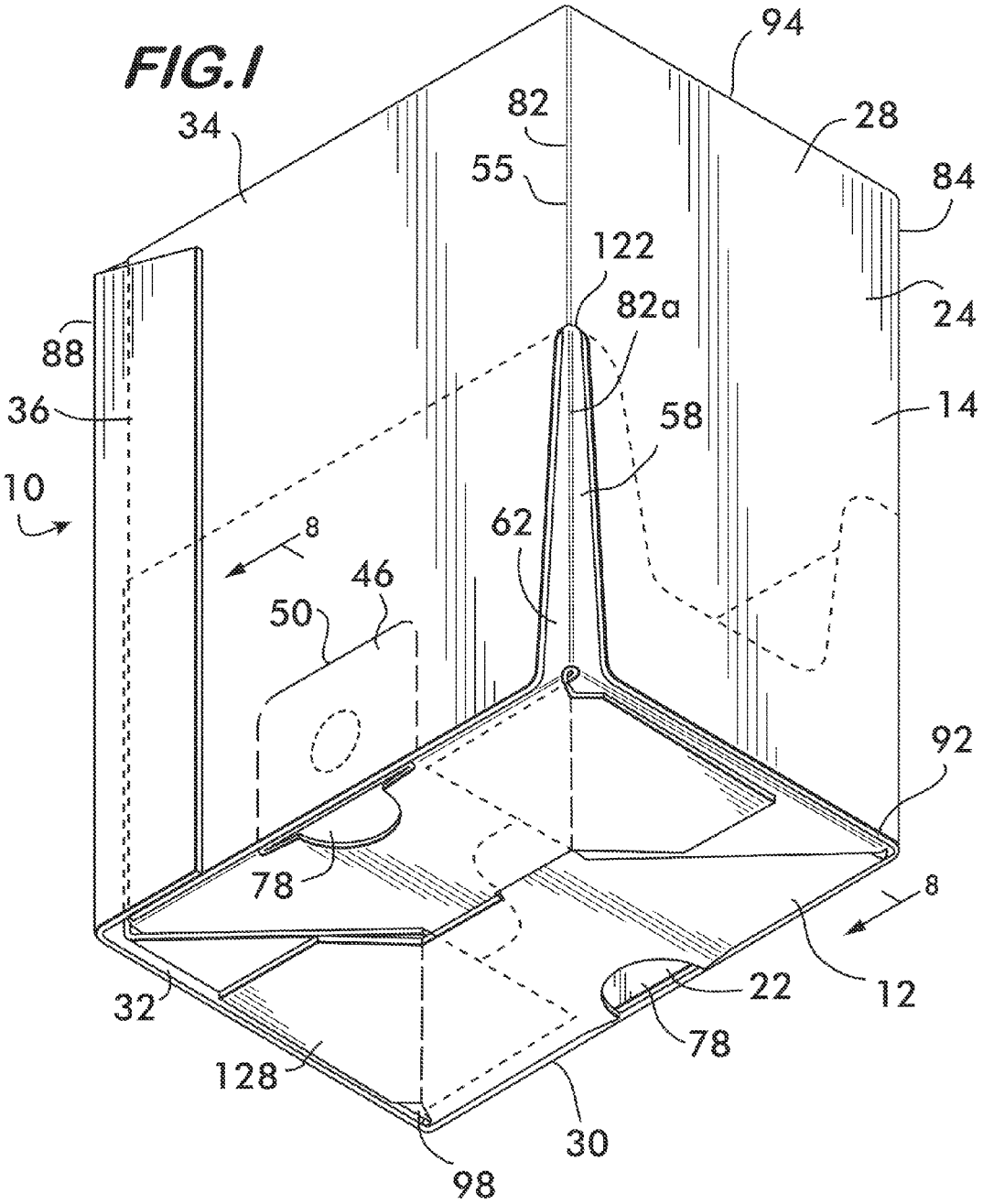
FIG. 1 is a perspective view of a container assembly made in accordance with the present invention showing the fully assembled closed container.
Figure 13:
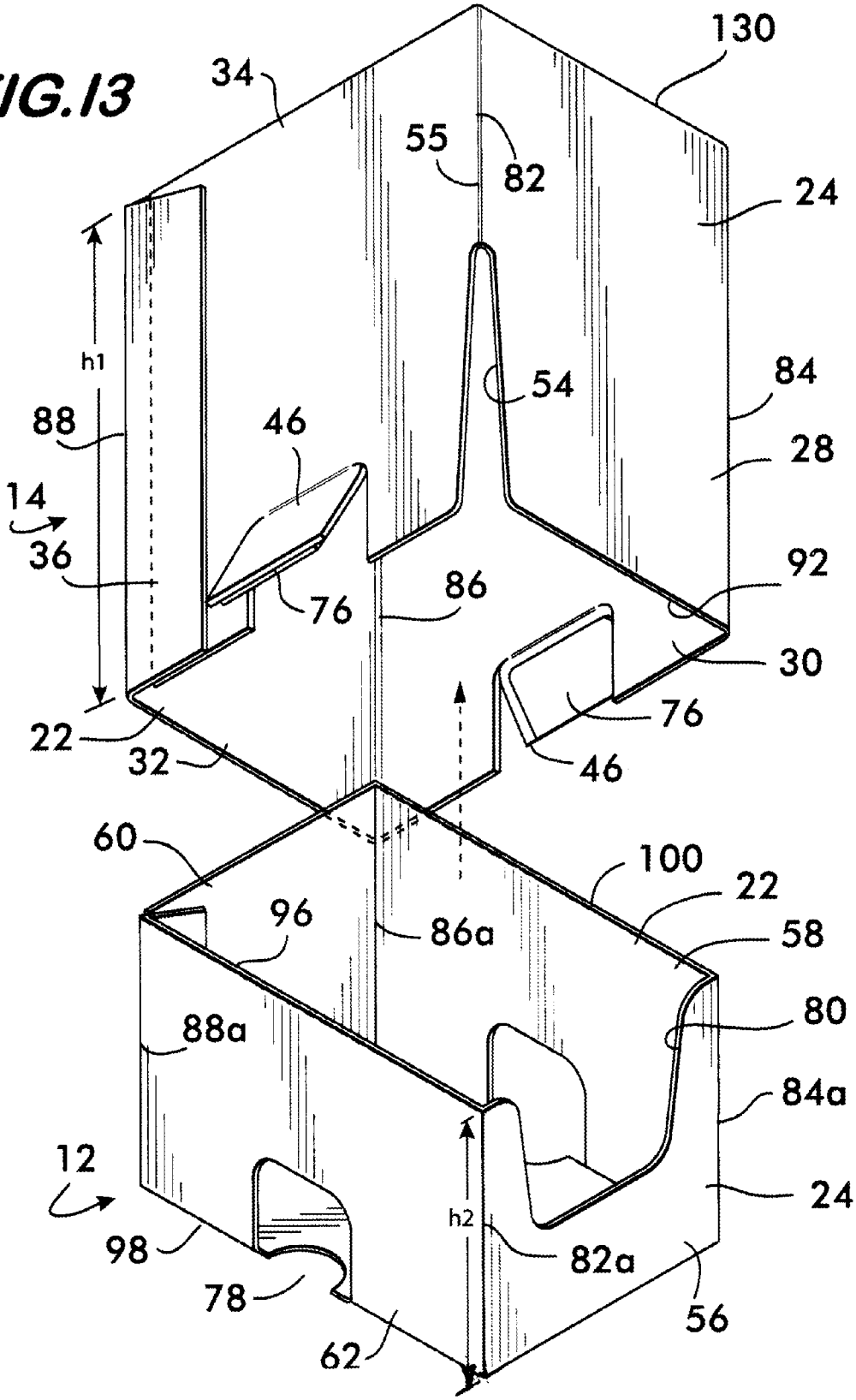
FIG. 13 is a perspective view of the container assembly of FIG. 1 showing the upper section separated from the lower section.

Reference now will be made in detail to the embodiment shown in FIG. 1 showing a fully erected display ready container assembly 10 having a lower/inner container section 12 shown partially in dotted line where hidden, and an upper/outer container section 14 which, in this embodiment, is configured to fit over the lower container section 12. See FIG. 13 showing the two container sections 12 and 14 shown separated from one another. These two container sections 12 and 14, with the lower container section 12 fixedly secured to the upper cover 14, form the display ready container assembly 10. FIG. 1 shows the container assembly 10 as it would appear loaded with retail goods within and closed for shipment. The lower container section 12 holds the goods to be contained within, and the upper section 14 acts as a protective cover/enclosure for shipping the goods within. The two sections 12, 14 are separated from one another at the retailer as shown in FIG. 13. Once separated, the lower section 12 with the goods therein can be displayed for sale of the items within, the upper section 14 discarded. As best seen in FIG. 13, the upper section 14 has a height greater than the height of the lower section 12, allowing the shipment and display of goods that extend beyond the walls of the inner section 12. The individual display ready container sections 12 and 14, and the assembly of the container 10 are further described below.

Figure 7:
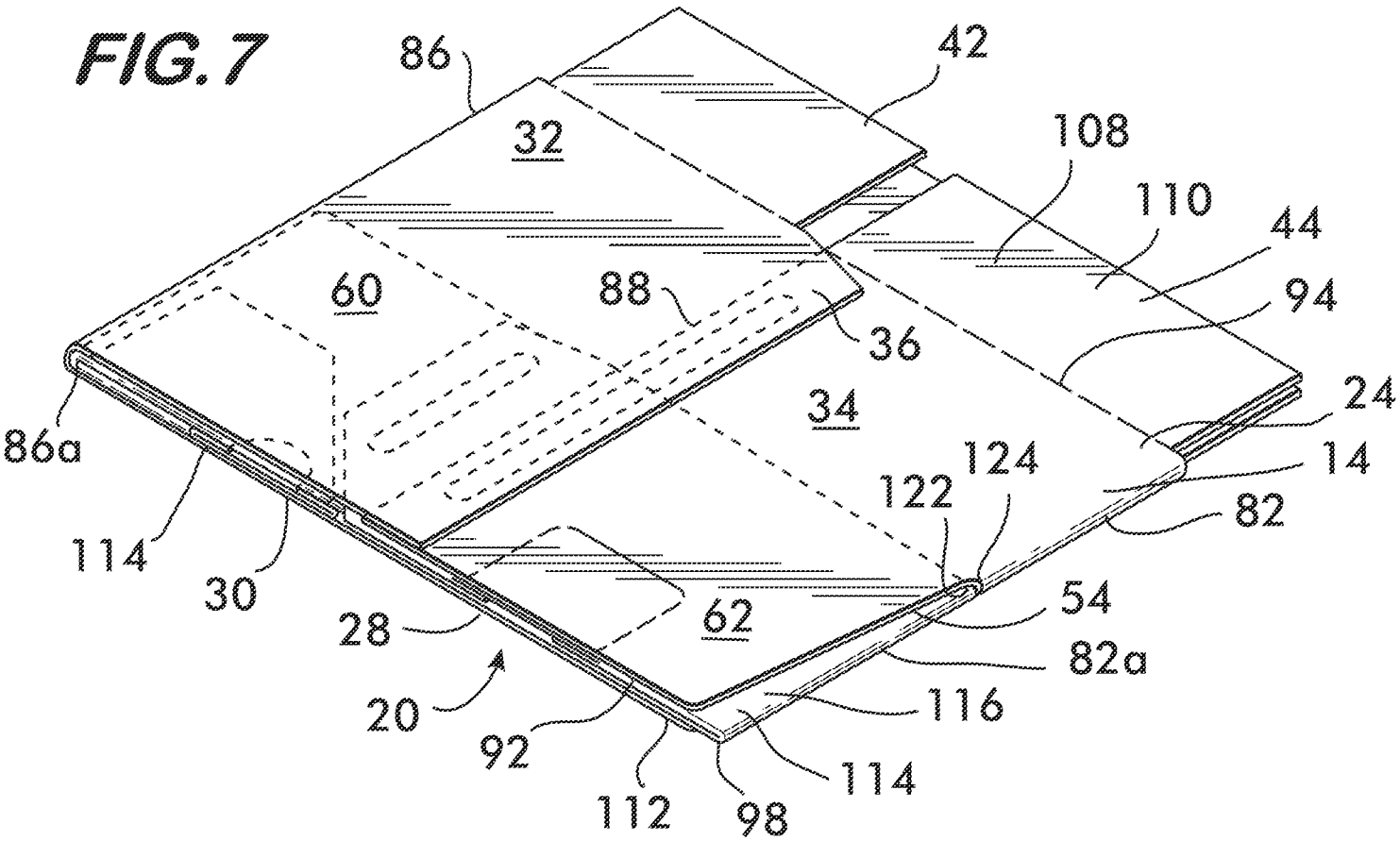
FIG. 7 is a perspective view showing a step of making the container assembly that comes after the step shown in FIG. 6, wherein the blanks have been folded to form a second corner of the knockdown, thereby forming a completed knockdown.

The manufacture and assembly of the container 10 begins preferably with the manufacture of the blank 16 for forming the upper container section 14, and the blank 18 for forming the lower container section 12. The two blanks are then combined and assembled into a knockdown assembly 20 as seen in FIG. 7, which knockdown 20 can be erected into the assembled open container 10 for receiving goods within. The manufacture and assembly of the container 10 is now described in detail.

Figure 2:
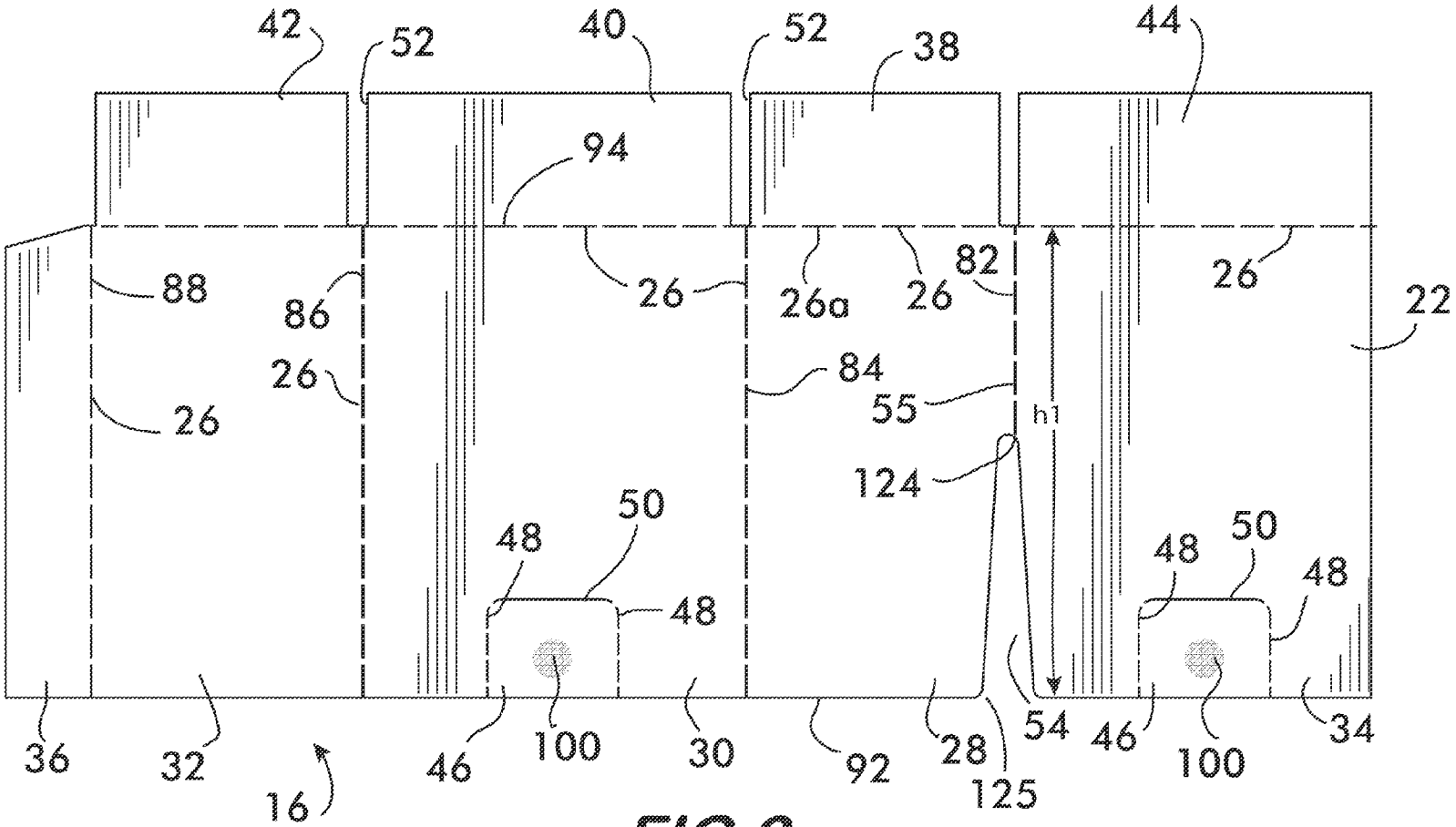
FIG. 2 is a plan view of a blank section for forming the upper/outer container section of the container assembly in FIG. 1.

With reference to FIGS. 1, 2 and 13, the upper/outer container section blank 16 is preferably die cut from a unitary sheet of corrugated paper board having an inner face 22 (shown in FIG. 2) and an outer face 24 (shown in FIG. 1). The blank 16 includes fold lines 26, preferably formed by scoring or any other suitable means of forming a line of weakness along which the panels will fold, for delineating the side wall panels 28, 30, 32 and 34 from one another, and which side wall panels will ultimately form the side walls of the upper section of the container assembly 10 as seen in FIGS. 1 and 13. A glue tab 36 is integrally connected to the wall panel 32, delineated by a fold line 26. Top forming flaps 38, 40, 42 and 44 are integrally attached to respective side panels as shown, and delineated there from by fold lines 26. Two tear away tabs 46 are provided on the blank 16 to be on opposing sides of the upper container section 14 when folded, here on the opposing side panels 30 and 34. See FIG. 13. The tabs 46 are formed with a series of perforations 48 that form a tear line to allow the tabs 46 to be detached from the wall panel along the tear line, and a score line 50 to allow hinged movement of the tabs 46 thereabout. Cut outs 52 between the top flaps allows clearance for easy folding. A cutout 54 having a length substantially similar to a height of the lower container section 12 is provided for reasons further discussed below. It is seen that the fold lines 26 between the wall panels 30-34 and glue tab 36 will define the corners of the upper section 14 of the assembled container 10, i.e., corners 82, 84, 86, and 88 as shown in FIG. 13. Finally, the lower edge 92 will form the bottom edge of the upper section 14, and the fold line **26*a* between the side panels 30, 32, 24, and 36 and the top forming flaps 38, 40, 42, and 44 will form the upper edge 94 of the upper section 14 when the top flaps are folded as seen in FIGS. 1. The cutout 54 is formed in and extends longitudinally along a section of the blank 16 of what will be the corner 82, it being seen that the corner 82 includes the cutout section 54 and an uncut section 55, and the cutout section has an upper end 124 and an open lower end 125 at the bottom edge 92 of the upper section 14**.

Figure 3:
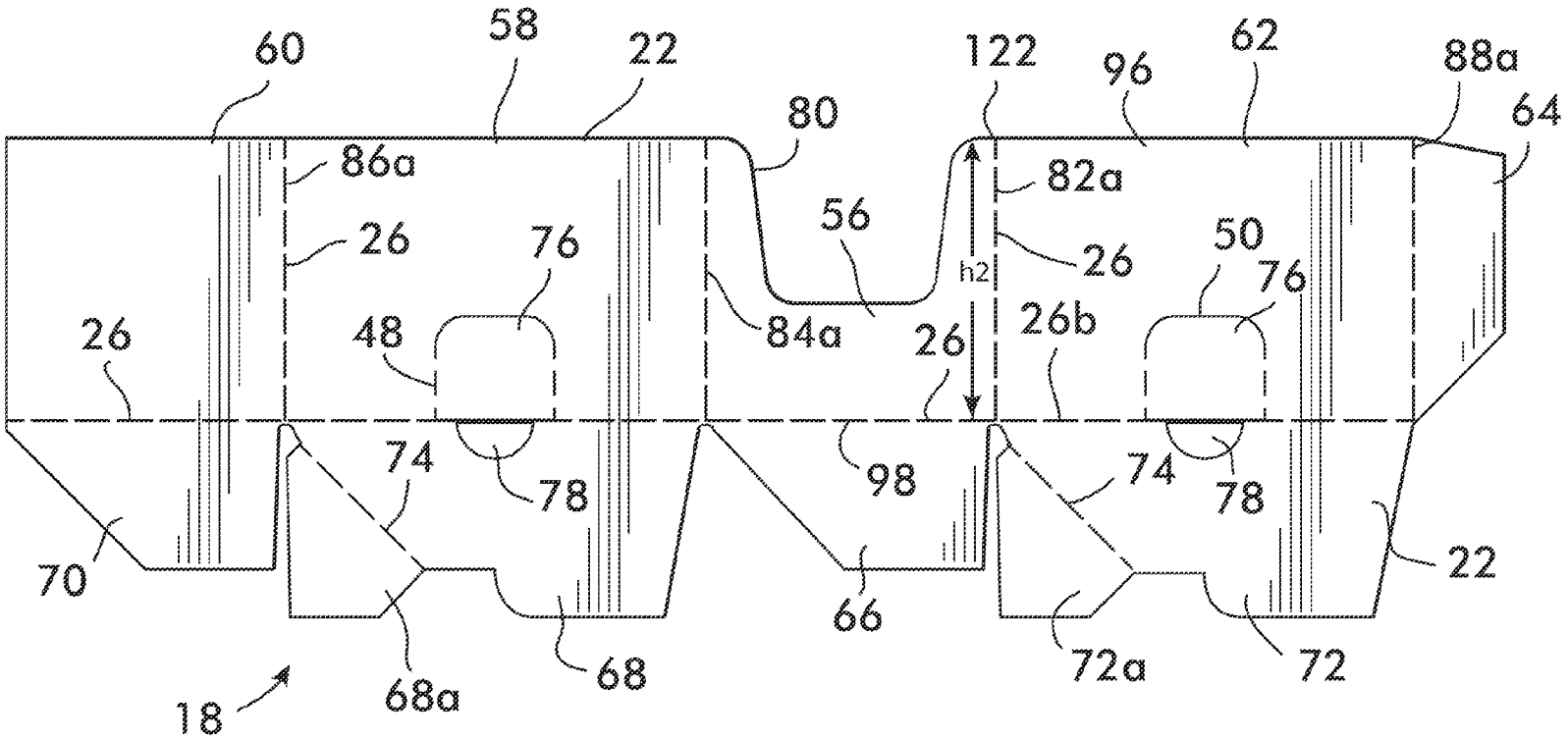
FIG. 3 is a plan view of a blank section for forming the lower/inner section of the container assembly in FIG. 1.

With reference to FIGS. 1, 3 and 13, the lower container section blank 18 is likewise preferably die cut from a unitary sheet of corrugated paper board having an inner face 22 (see FIG. 2) and an outer face 24 (see FIG. 13). Here, in the illustrated embodiment, a thinner flute is used as compared to the upper/outer blank 16 as the thinner flute is easier to print on and the strength of a thicker flute is not needed in this particular embodiment. A white paper outer face is preferred on the outer face 24 for the printing, but not necessary. The blank 18 includes fold lines 26, preferably formed by scoring or any other suitable means, for delineating the lower section side wall panels 56, 58, 60 and 62 from one another, and which side panels will ultimately form the side walls of the lower section of the container 10 as seen in FIGS. 1 and 13. A glue tab 64 is integrally connected to the wall panel 62, delineated by a fold line 26. Bottom forming flaps 66, 68, 70 and 72 are integrally attached to respective side panels as shown, and delineated there from by fold lines 26. Fold lines 74, here formed of a series of perforations although any suitable type of fold line can be used, delineate partial flaps 68*a* and 72*a* from respective flaps 68 ands 72 as shown for further folding as described below. Two tear away tabs 76 are provided on the blank 18 to be on opposing sides of the container 10, here on the opposing side panels 58 and 62, and which will align with the tear away tabs 46 of the upper blank 16. See FIGS. 12 and 13. The tabs 76 are formed with a series of perforations and cuts 48 to allow the tab to completely break free from the wall panels 58, 62 as described below. Cut outs 78 are provided adjacent to and along the bottom of the tear away tabs 76 to allow a user's finger to access the inner face 22 of the tear away tabs 76 for purposes described below. A display opening 80 in the side panel 56 is provided to allow easy access to the goods within when the container is opened at the retailer. It is seen that the fold lines 26 between the wall panels and glue tab 64 will define the corners of the lower 12 section of the erected container 10, which corners will align with and correspond to the corners of the upper section 14, i.e., corners 82*a*, 84*a*, 86*a* and 88*a*. Finally, the upper edge 96 will form the upper edge of the lower section 12, and the fold line 26*b* between the side wall panels 56, 58, 60 and 62 and the bottom forming flaps 66, 68, 70 and 72 will form the lower edge 98 of the lower section 12 when the bottom flaps are folded as seen in FIGS. 1 and 13.

Figure 4:
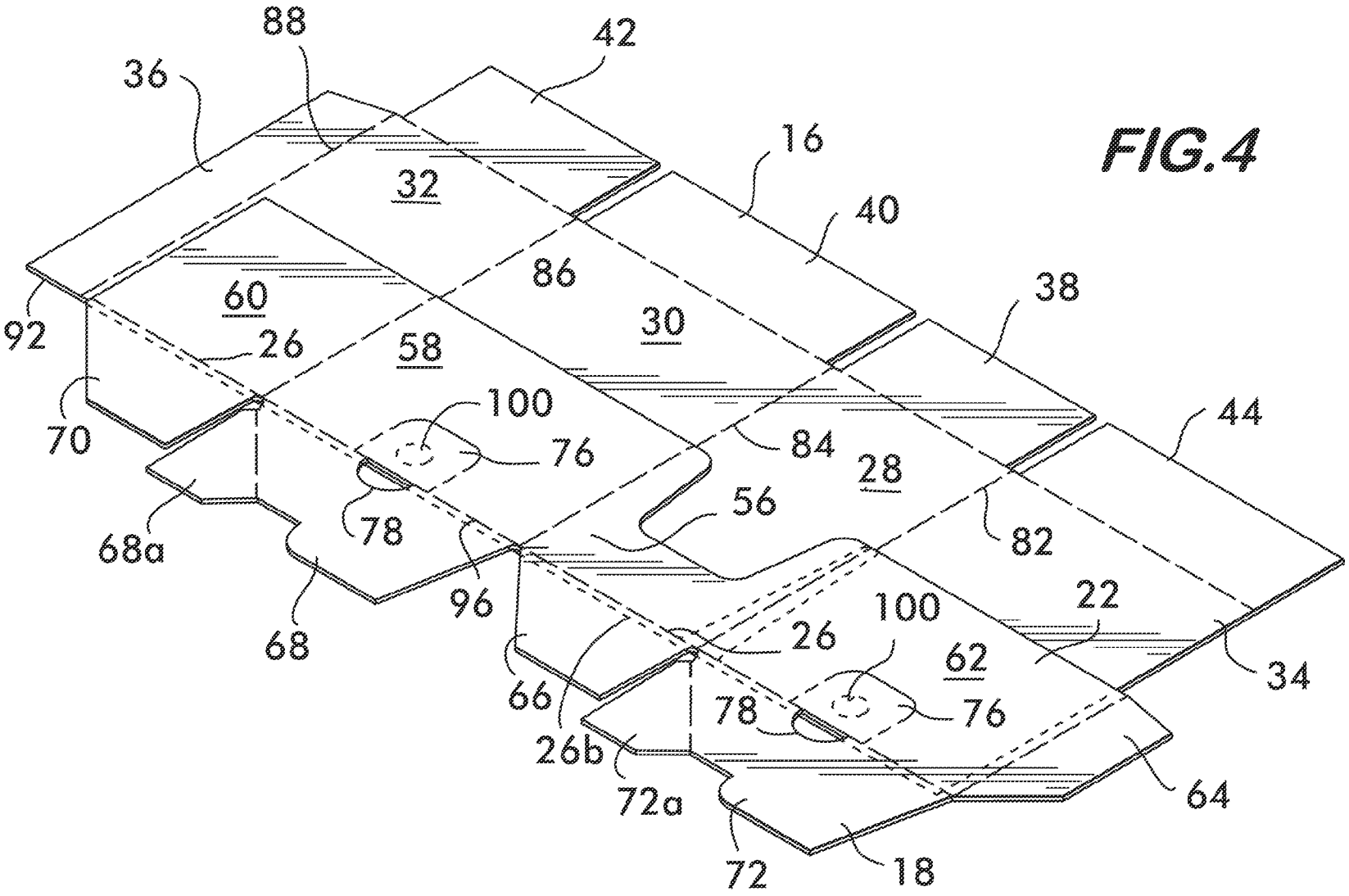
FIG. 4 is a perspective view showing a step of making the container assembly of FIG. 1, where the lower/inner section blank of FIG. 3 is positioned on the inner face of the upper/outer section blank of FIG. 2.

The two blanks 16 and 18 are combined to form the two sided knockdown 20 (see FIG. 7) which can be erected into the final container assembly 10 as shown in FIG. 1. The assembly of the knockdown 20 from the two blanks 16, 18 is now described with further reference to FIGS. 4, 5, 6 and 7. With initial reference to FIG. 4, an adhesive, preferably a cold set glue, is applied to the glue areas 100 (see FIG. 2) of the upper blank 16 (illustrated in dotted line in FIG. 4). Cold set glue is used to allow for slight movement of the blanks 14, 16 relative to one another as the assembly is being folded to form the knockdown 20 before the glue sets. The lower blank 18 is then placed onto the upper blank 16 as shown in FIG. 4 such that the tear away tabs 76 of the lower blank 18 align over the tear away tabs 46 of the upper blank 16 to adhere to one another via the adhesive, the fold line 26*b* that will form the bottom edge 98 of the assembled lower section 12 is aligned with the bottom edge 92 of the upper blank 16, and the fold line sections 26 of the lower blank 18 that will form the corners 82*a* and 86*a* are aligned with the fold lines 26 of the upper blank 16 that will form the corners 82 and 86. The distance between the two corners 82*a* and 86*a* of the lower blank 18 may be slightly less than the distance between the corners 82 and 86 of the upper blank 16 since the lower blank 18 will be, when folded, inside the outer blank 16 and thus have a smaller length or circumference, it being desirable however to minimize the tolerances between the two sections to minimize potential slack and movement between them when folded. With modern machinery the above described process is carried automatically, the glue being applied by the machine and then the lower blank 18 placed into the desired position onto the upper blank 16. It is appreciated that the two blanks 16, 18 are combined in a "positional relationship" of the two sections as they will be in the assembled container assembly 10 as seen in FIG. 1, i.e., the two sections 16, 18 are attached to one another in the same relative positions to one another as they will be in the final container assembly 10. When the container is opened into its assembled form as seen in FIG. 1, the upper section will be already attached to the lower section in the position for enclosing the goods within.

Figure 5:
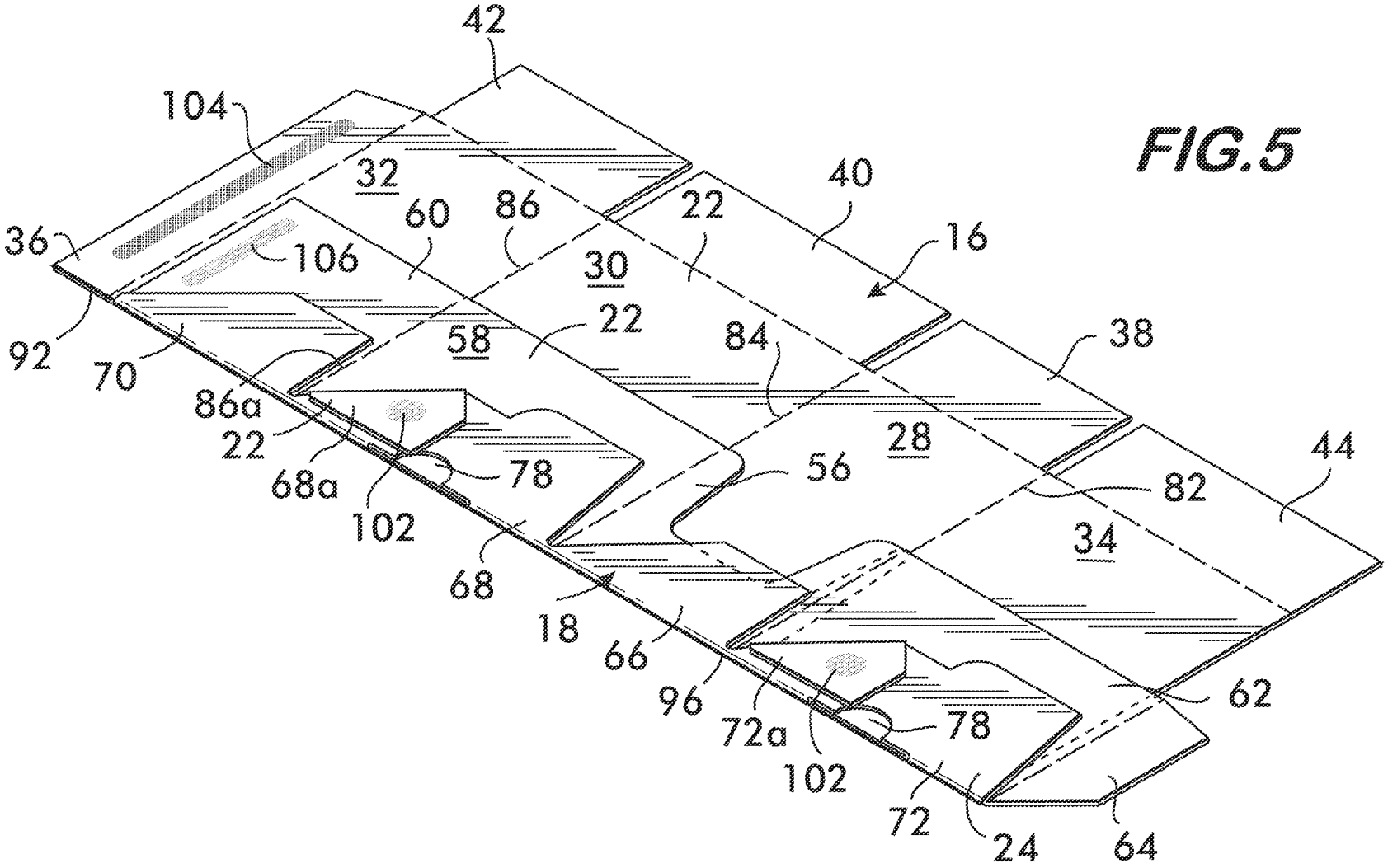
FIG. 5 is a perspective view showing a step of making the container assembly that comes after the step shown in FIG. 4 where the bottom forming panels have been folded.

Next the bottom forming flaps are folded. With further reference to FIGS. 4 and 5, the bottom forming flaps 66, 68, 70, and 72 are folded about fold line 26 onto the inner face 22 of the adjacent wall panels 28, 30, 32, and 34, as seen in FIG. 5. In the automated process, these flaps are all folded at the same time, with the flaps 68*a* and 72*a* being folded back onto respective flaps 68 and 72 by a pick bar during the folding process of flaps 68 and 72. This configuration provides for an auto bottom which automatically forms the container bottom 128 of the container assembly 10 when it is erected from its knockdown form.

Figure 6:
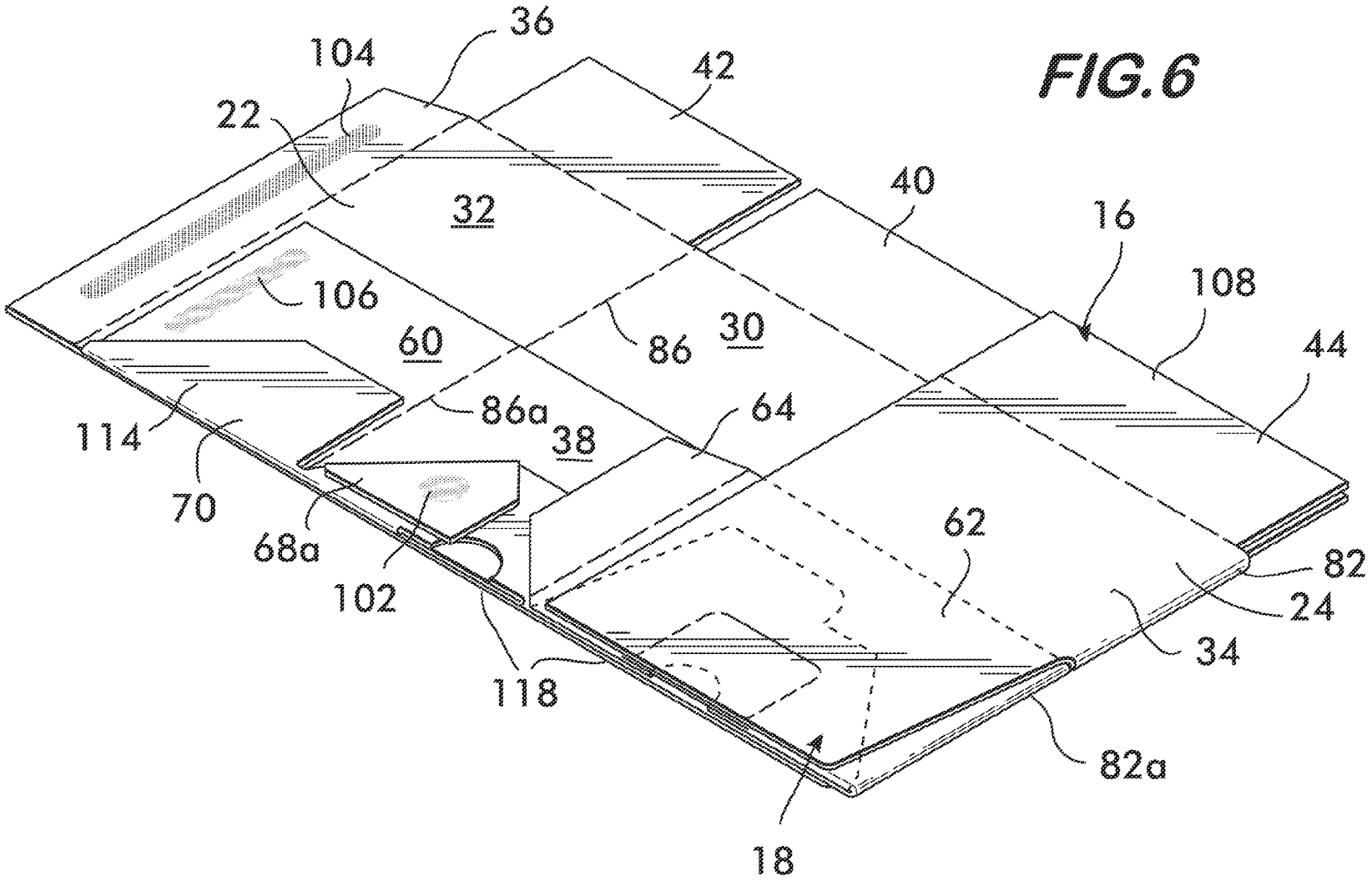
FIG. 6 is a perspective view showing a further step of making the container assembly that comes after the step shown in FIG. 5 wherein the blanks have been folded to form one corner of a knockdown.

Next, with further reference to FIG. 6, adhesive, such as hot melt or cold set glue is applied to glue areas 102 on bottom flaps 68*a* and 72*a*, and glue areas 104 and 106 of the upper blank 16 and the lower blank 18, respectively. See FIG. 5. Upper/outer section wall panel 34 (with integrally connected top panel 44) and lower section wall panel 62 (with integral bottom flap 72) are then folded as a unit about fold lines 26 (corner 82) onto the inner face 22 of the remainder of the blanks to form respective corners 82 and 82*a* of the upper and lower sections 12 and 14 as seen in FIG. 6. Upper/outer section wall panel 32 (with integrally connected top panel 42) and lower section wall panel 60 (with integral bottom flap 70) are then folded as a unit about fold lines 26 (corner 86) onto the outer face 24 of the wall and bottom panels 34 and 62 to form the corners 86 and 86*a* and which completes the assembly of the finished knockdown 20 as seen in FIG. 7. It is appreciated that automated machinery can carry out the folding operation to form the two corners 82 and 86 almost simultaneously, the panels 34 and 62 being folded sufficiently prior to the folding of the panels 32 and 60 so that the panels 32 and 60 come down onto the outer face 24 of the panels 34 and 62. It is further appreciated that the slower set time of the cold set glue between the two sections 16, 18 allows time for slight movement of the two sections relative to one another during the folding process. The lower tolerances between the two sections in the preferred embodiment allows the folding process itself to help align and square up the two sections relative to one another should there be a slight misalignment.

With particular reference to FIG. 7 showing the completed knockdown assembly 20, it is seen that the knockdown 20 has an outer/upper sleeve 108 forming two opposing side panels 110 and 112 which are attached to one another at opposing corners 82 and 86. Knockdown wall panel 110 includes the upper wall panels 32 and 34 (and the top flaps integrally connected thereto) in a substantially same plane, and knockdown wall panel 112 includes the upper wall panels 28 and 30 (and the top flaps integrally connected thereto) in a substantially same plane which is parallel to the wall panel 108. Substantially same plane means generally flat accounting for slight curves and warps possible with such paper and cardboard products. It is further seen that the knockdown 20 has an inner/lower sleeve 114 sandwiched between the outer sleeve 108 and which forms two opposing side panels 116 and 118 which are attached to one another at opposing corners 82*a* and 86*a*. Wall panel 116 includes the lower wall panels 60 and 62 (and the bottom flaps integrally connected thereto) in a substantially same plane, and wall panel 118 includes the lower wall panels 56 and 58 (and the top flaps integrally connected thereto) in a substantially same plane parallel to the wall panel 116. If is further seen that inner sleeve 114 is secured within the outer sleeve 108 in the positional relationship relative to one another that they will be in when the container assembly is erected as seen in FIG. 1. Additionally, the opposing corners 82*a* and 86*a* of the inner sleeve 114 are seen to align with so as to be adjacent to the opposing corners 82 and 86 of the outer sleeve 108 and thus capable of opening together as the container assembly 10 is erected. With further reference to FIGS. 1, 2, 3 and 13, it is seen that a height h1 of the outer sleeve 14 is greater than a height h2 of the inner corner 82*a*.

With further reference to FIGS. 7 and 11, it is seen that corner 82*a* of the lower/inner section 114 extends or pushes into the cut out 54 of the upper/outer section 14 as the knockdown 20 is folded into final form, exposing at least a portion of the corner 82*a*. Preferably, an upper end 124 of the cutout 54 is positioned below the top edge 122 of the inner corner 82*a* or, put another way, of the corner 82*a* corner extends up behind the upper edge 124 of the cutout 54 by a small amount, e.g., an overlap of about 1/32 to 1/16 of an inch being preferred—just enough to allow the upper/outer section 14 to "pinch" or "catch" the lower/inner section 12 and help hold it in position. Other overlaps, such as up to 1/4 inch are also possible. The greater the overlap, the greater the chances for buckling. The cut out 54 allows for smaller tolerances between the two container sections 12 and 14 such as a tighter wrap of the upper/outer section 14 around the lower/inner section 12 to minimize slack and movement of the lower/inner section 12 relative to the upper/outer section 14 during the folding process to make the knockdown 20 and helps maintain the proper square alignment between the two container sections 12, 14. Moreover, use of the more precise tolerances allows the folding process to help square and align the two knockdown sections 16, 18 relative to one another, as they engage one another, should there be any slight misalignment between the two. This provides a much more reliable container with less failures, i.e., less containers that will not open properly due to misalignment of the two sections. The thickness of the cut-out opening is based on the thickness of the of the lower/inner section 18 when folded. Here, where the auto-bottom configuration of the bottom flaps leads to a thicker section 18 along the bottom, a thicker opening 54 is required.

The cut out 54 also prevents buckling of the wall panels of the lower/inner section 12 when the knockdown is opened, providing room for the inner section to expand if necessary. This is particularly helpful where the container assembly sections are made with tight tolerances, which allows little room for expansion during the assembly of the container 10 other than into the cut out 54.

Figure 8:
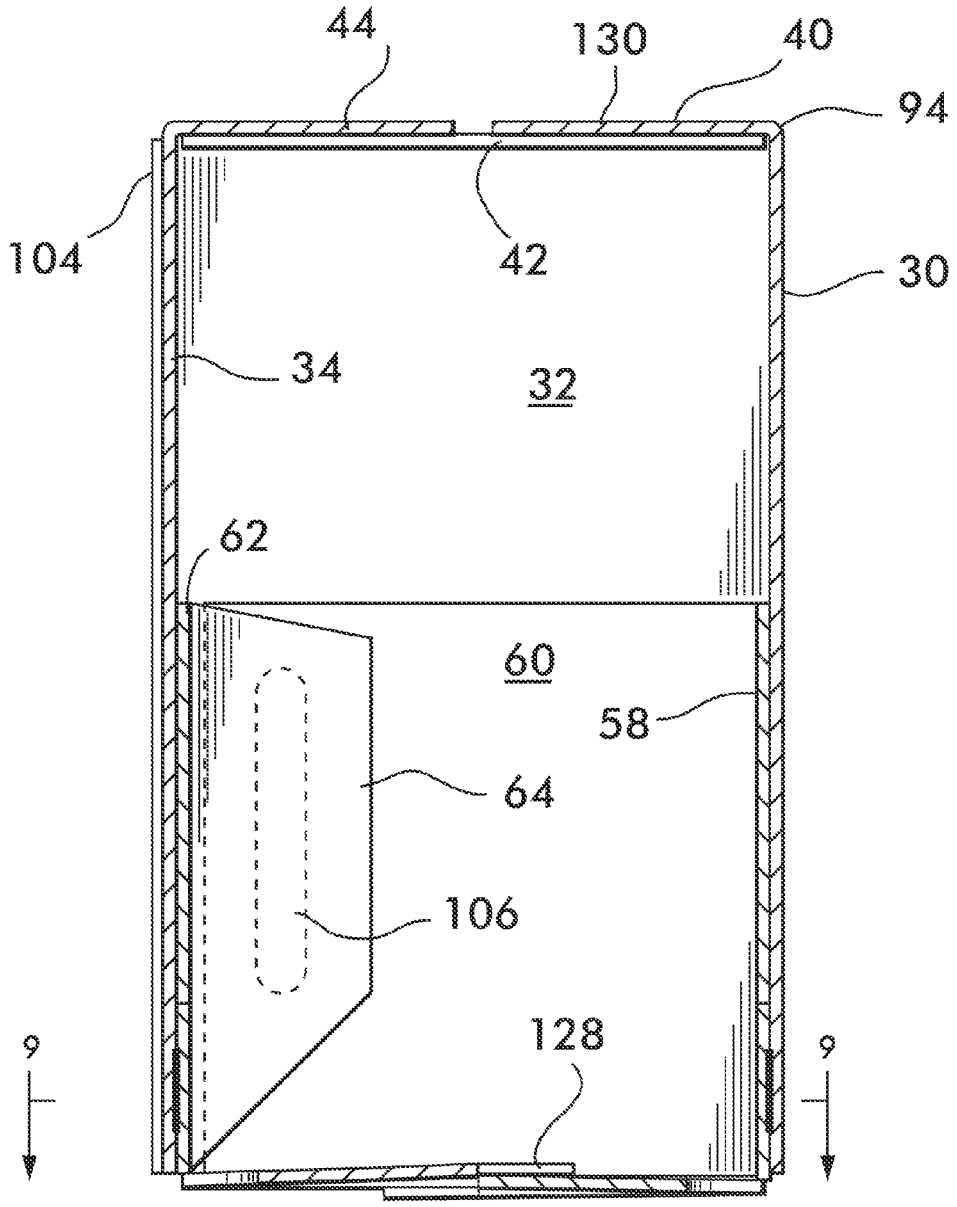
FIG. 8 is a cross-sectional view of the container assembly of FIG. 1 taken along line 8-8.
Figure 9:
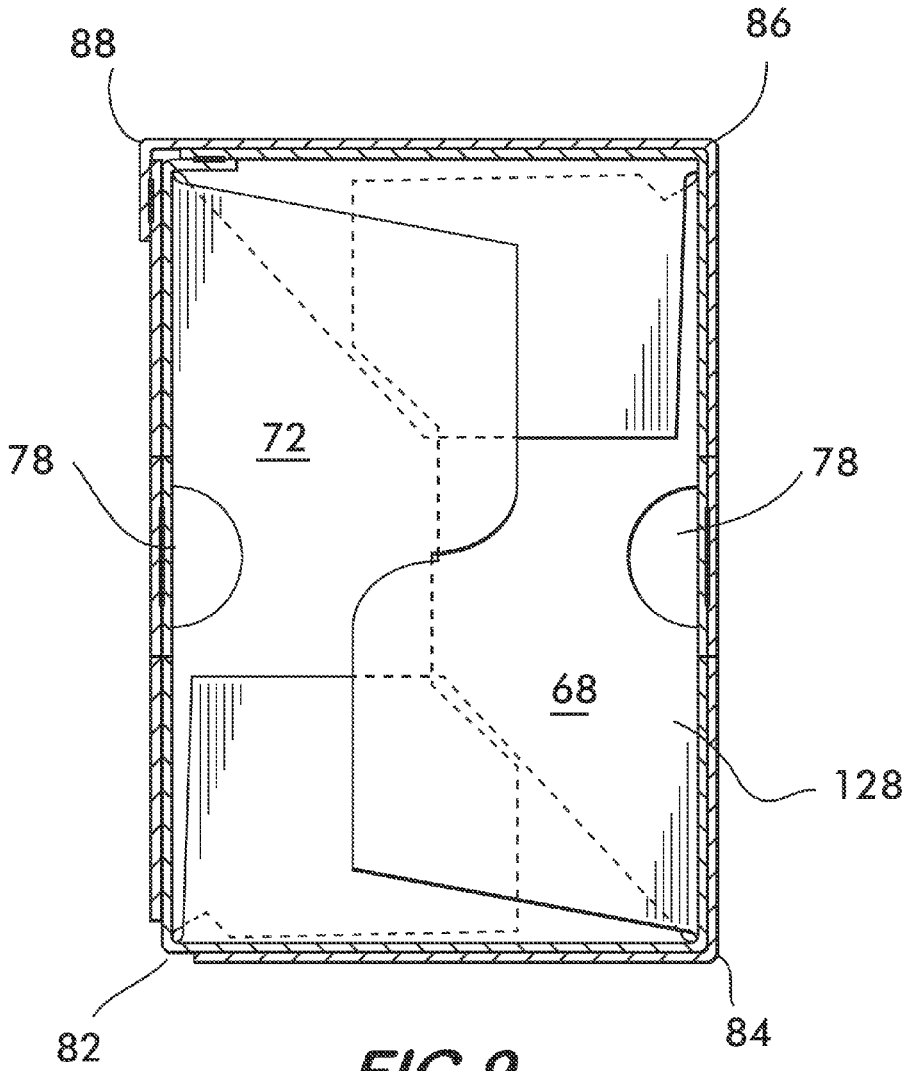
FIG. 9 is a cross-sectional view of the container assembly of FIG. 1 taken along lines 9-of 9 of FIG. 8.

Referring to FIGS. 1, 7 and 10, the container knockdown assembly 20 is erected into an opened container 10 by pushing the corners 82 and 86 toward each other, thereby folding and forming the corners 84 and 88 of the upper cover section 14 until an erected container assembly 10 is formed as shown in FIG. 1. It is seen that this opens both of the outer and inner sleeves 108, 114 as a single unit. The bottom forming flaps form the bottom as part of the erecting process, readying the container assembly 10 to be loaded with goods. See FIGS. 8 and 9 showing the assembled bottom. Once the goods are loaded, the top forming flaps 38, 40, 42, and 44 are folded and secured to form the container top 130 and enclose the goods within the container 10 for shipment. It is seen that in this preferred embodiment, the height of the sidewalls 16 and 54 of respective lower container section 12 and outer cover 14 are not the same, the lower section being shorter in height to help display the goods therein. Other configurations of height are possible.

Figure 12:
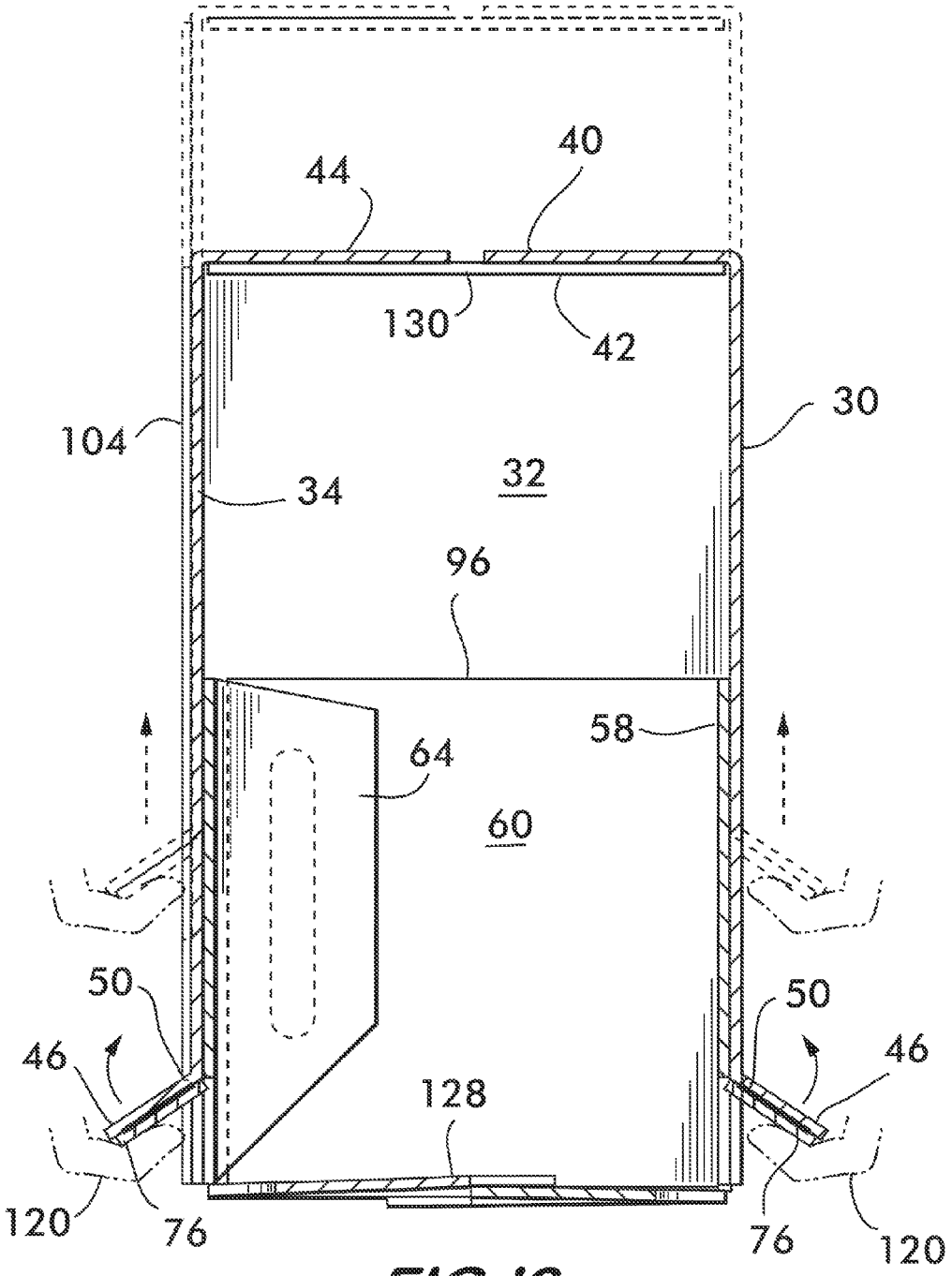
FIG. 12 is a cross sectional view of the container assembly of FIG. 1 illustrating the removal of the upper section from the lower section.

With further reference to FIGS. 1, 12 and 13, the removal of the upper section/cover 14 from the lower section 12 to display the goods held within is now described. The user places his or her fingers 120 into each of the opposing openings 78 to pull the tear away tabs 46, 76 outwardly as shown in FIG. 12. Inner section tabs 76 detach completely from the inner section 12, while the outer section tabs 46, hingeably connected at the upper hinge line 50 move outwardly with the detached tabs 76. Since the two sections 12 and 14 were adhered to each other only at these tabs, the detachment of the tab 76 from the lower section 12 allows the upper section/cover 14 to be lifted up and off of the lower section as seen in FIG. 12 (the weight of the goods within the container holds the lower section down while the upper section is being removed). It is seen that since the two tabs 46 and 76 are adhesively attached to one another, and the tabs 46 remains attached to the upper section 14, no scraps or discarded materials are left behind.

Since the lower container section 10 may be used to display the goods on the retail floor, the outer face 24 of the lower section side walls may be printed with an esthetic design or some suitable promotional information.

The present invention thereby provides a container knockdown assembly 20, which is simple and efficient to make, and a container assembly 10 which in a preferred form, is easily erected from a knockdown assembly 20, both of which are improved over previously known display ready containers. The present invention also provides a method for making the knockdown.

While particular embodiments of the invention are described herein, it is not intended to limit the invention to such disclosure. Changes and modifications may be incorporated and embodied within the scope of the appended claims. For example, the inner and outer container sections 12 and 14 can be made of materials other than corrugated paperboard, such as non-corrugated paperboard, or combinations thereof. In such an example, the upper/outer container section could be made of corrugated while the lower/inner container section could be made of non-corrugated paperboard.

What is claimed is:

1. A container knockdown assembly capable of opening into an erected container assembly, comprising:

an unopened outer sleeve having first and second outer side panels opposing and substantially parallel to one another when in the knockdown form and which are attached to one another at two outer sleeve corners on opposite ends of said outer sleeve, said outer sleeve capable of being opened to form four outer container side walls of the erected container assembly;

an unopened inner sleeve having first and second inner side panels opposing and substantially parallel to one another when in the knockdown form and which are attached to one another at two inner sleeve corners on opposite ends of said inner sleeve, said inner sleeve capable of being opened to form four inner container side walls of the erected container assembly;

said inner sleeve being secured within said outer sleeve in a positional relationship of the erected container assembly, one of said two inner corners aligning with a one of said two outer corners and the other of said two inner corners aligning with an other of said outer two corners; and a cutout formed in a section of said one outer corner exposing at least a portion of said one inner corner;

wherein said outer sleeve has a height greater than a height of said one inner corner.

2. A container knockdown assembly in accordance with claim 1 wherein said cutout has an upper end positioned below a top edge of said one inner corner.

3. A container knockdown assembly in accordance with claim 2 wherein said cutout extends from said upper end to a bottom edge of said outer sleeve.

4. A container knockdown assembly in accordance with claim 3 wherein said upper end of said cutout is no more than about ½ inch below a top end of said one inner corner.

5. A container knockdown assembly in accordance with claim 3 wherein said upper end of said cutout is no more than about 1/16 inch below the top edge of said one inner corner.

6. A container knockdown assembly in accordance with claim 1 wherein said knockdown inner sleeve includes container bottom forming flaps.

7. A container knockdown assembly in accordance with claim 6 wherein said knockdown outer sleeve includes container top forming flaps.

8. A container knockdown assembly in accordance with claim 1 wherein said cutout has an upper end positioned above a top edge of said one inner corner.

9. A container knockdown assembly in accordance with claim 1 wherein said inner and outer sleeves are secured to one another with an adhesive.

10. An container assembly formed from the knockdown in accordance with claim 1.

11. A container knockdown assembly capable of opening into an erected container assembly, comprising:

an unopened outer sleeve having first and second outer side panels opposing and substantially parallel to one another when in the knockdown form and which are attached to one another at two outer sleeve corners on opposite ends of said outer sleeve, said outer sleeve capable of being opened to form four outer container side walls of the erected container assembly;

an unopened inner sleeve having first and second inner side panels opposing and substantially parallel to one another when in the knockdown form and which are attached to one another at two inner sleeve corners on opposite ends of said inner sleeve, said inner sleeve capable of being opened to form four inner container side walls of the erected container assembly;

said inner sleeve being secured within said outer sleeve in a positional relationship of the erected container assembly, one of said two inner corners aligning with a one of said two outer corners and the other of said two inner corners aligning with an other of said outer two corners; and a cutout formed in a section of said one outer corner exposing at least a portion of said one inner corner;

wherein said one outer corner has a top edge positioned above a top edge of said one inner corner, and said cutout has an upper end and a lower end and wherein said cutout comprises at least one opening extending along said one outer corner from said upper end to said lower end.

12. A container knockdown assembly capable of opening into an erected container assembly, comprising:

an unopened outer sleeve having first and second outer side panels opposing and substantially parallel to one another when in the knockdown form and which are attached to one another at two outer sleeve corners on opposite ends of said outer sleeve, said outer sleeve capable of being opened to form four outer container side walls of the erected container assembly;

an unopened inner sleeve having first and second inner side panels opposing and substantially parallel to one another when in the knockdown form and which are attached to one another at two inner sleeve corners on opposite ends of said inner sleeve, said inner sleeve capable of being opened to form four inner container side walls of the erected container assembly;

said inner sleeve being secured within said outer sleeve in a positional relationship of the erected container assembly, one of said two inner corners aligning with a one of said two outer corners and the other of said two inner corners aligning with an other of said outer two corners; and a cutout formed in a section of said one outer corner exposing at least a portion of said one inner corner;

wherein said outer sleeve has a bottom edge, and said cutout extends to and is open at said bottom edge.

13. A container knockdown assembly in accordance with claim 12 wherein said cutout comprises an upper end and a lower end, which lower end coincides with said bottom edge of said outer sleeve.

14. A container knockdown assembly in accordance with claim 13 wherein said cutout is tapered so as to be wider at said lower end than at said upper end.

15. A container knockdown assembly capable of opening into an erected container assembly, comprising:

an unopened outer sleeve having first and second outer side panels opposing and substantially parallel to one another when in the knockdown form and which are attached to one another at two outer sleeve corners on opposite ends of said outer sleeve, said outer sleeve capable of being opened to form four outer container side walls of the erected container assembly;

an unopened inner sleeve having first and second inner side panels opposing and substantially parallel to one another when in the knockdown form and which are attached to one another at two inner sleeve corners on opposite ends of said inner sleeve, said inner sleeve capable of being opened to form four inner container side walls of the erected container assembly;

said inner sleeve being secured within said outer sleeve in a positional relationship of the erected container assembly, one of said two inner corners aligning with a one of said two outer corners and the other of said two inner corners aligning with an other of said outer two corners; and a cutout formed in a section of said one outer corner exposing at least a portion of said one inner corner;

wherein said cutout comprises a single opening extending along said one outer corner from a cutout upper end to a bottom edge of said one outer corner.

16. A container knockdown assembly in accordance with claim 15 wherein said cutout has an upper end positioned below a top edge of said one inner corner.

17. A container knockdown assembly capable of opening into an erected container assembly, comprising:

an unopened outer sleeve having first and second outer side panels opposing and substantially parallel to one another when in the knockdown form and which are attached to one another at two outer sleeve corners on opposite ends of said outer sleeve, said outer sleeve capable of being opened to form four outer container side walls of the erected container assembly;

an unopened inner sleeve having first and second inner side panels opposing and substantially parallel to one another when in the knockdown form and which are attached to one another at two inner sleeve corners on opposite ends of said inner sleeve, said inner sleeve capable of being opened to form four inner container side walls of the erected container assembly;

said inner sleeve being secured within said outer sleeve in a positional relationship of the erected container assembly, one of said two inner corners aligning with a one of said two outer corners and the other of said two inner corners aligning with an other of said outer two corners; and a cutout formed in a section of said one outer corner exposing at least a portion of said one inner corner;

wherein said one outer corner comprises an upper section and a lower section, said cutout being formed in said lower section and extending to a bottom end of said one outer corner.

18. A container knockdown assembly capable of being erected into a container assembly having an inner container section and an outer container section which fits over the inner section, wherein the inner container section includes four inner container side walls and the outer container section includes four outer container side walls, the knockdown assembly comprising:

an inner sleeve which forms the inner container section when erected, said inner sleeve having first and second inner side panels opposing and substantially parallel to one another when in the knockdown form and which first and second inner side panels are attached to one another at two inner sleeve corners which oppose one another, said first inner side panel being substantially flat and including two of the inner container side walls, and said second inner side panel being substantially flat and including two other of the inner container side walls;

an outer sleeve which forms the outer container section when erected, said outer sleeve having first and second outer side panels opposing and substantially parallel to one another when in the knockdown form and which first and second inner side panels are attached to one another at two outer sleeve corners which oppose one another, said first outer side panel being substantially flat and including two of the outer container side walls, and said second outer side panel being substantially flat and including two other of the outer container side walls;

said inner sleeve being fixed in position within said outer sleeve in a positional relationship of the erected container assembly, one of said two inner corners aligning with a one of said outer two corners and the other of said two inner corners aligning with an other of said outer two corners; and a cutout formed in and extending along a section of said one outer corner exposing at least a portion of said one inner corner, said cutout having an upper end and a lower end and extends along said outer corner between said upper and lower ends, said outer sleeve having a height greater than a height of said one inner corner.

19. A container knockdown assembly in accordance with claim 18 wherein said cutout upper end is positioned below a top edge of said one inner corner.

* * * * *